US007694788B2

(12) United States Patent
Hann

(10) Patent No.: US 7,694,788 B2
(45) Date of Patent: Apr. 13, 2010

(54) TOOL BAG WITH INTEGRATED EXTERIOR FOAM PAD

(76) Inventor: Jamie Hann, 46 Bramcedar Crescent, Brampton, Ontario (CA) L7A 1T3

( * ) Notice: Subject to any disclaimer, the term of this patent is extended or adjusted under 35 U.S.C. 154(b) by 410 days.

(21) Appl. No.: 11/654,313

(22) Filed: Jan. 17, 2007

(65) Prior Publication Data

US 2008/0190798 A1 Aug. 14, 2008

(51) Int. Cl.
*A45C 9/00* (2006.01)

(52) U.S. Cl. ..... 190/1; 297/188.01; 297/219.1; 297/256.16; 224/155; 190/8; 5/420

(58) Field of Classification Search ..... 5/420; 190/1, 8; 224/153, 155; 297/188.01, 219.1, 297/256.16

See application file for complete search history.

(56) References Cited

U.S. PATENT DOCUMENTS 3,323,151 A * 6/1967 Lerman ..... 5/722
3,544,054 A 12/1970 Ward
4,034,424 A 7/1977 Budlong
4,059,207 A * 11/1977 Jackson et al. ..... 224/413
4,789,046 A 12/1988 McDowell
4,830,245 A * 5/1989 Arakaki ..... 224/628
5,255,834 A * 10/1993 Bendersky ..... 224/657
5,546,671 A 8/1996 Kehoe
5,573,155 A * 11/1996 Sadler ..... 224/155
D376,481 S 12/1996 Bidwell et al.
5,819,999 A * 10/1998 Tennant ..... 224/155
5,957,349 A * 9/1999 Krulik ..... 224/155
5,988,465 A * 11/1999 Vitale et al. ..... 224/155
D447,850 S 9/2001 Escobedo
6,883,177 B1 4/2005 Ouellette et al.
7,222,705 B1 * 5/2007 Guza ..... 190/1
2002/0023937 A1 * 2/2002 O'Hare ..... 224/155
2003/0019007 A1 1/2003 Spencer

* cited by examiner

*Primary Examiner*—Tri M Mai

(57) ABSTRACT

The present invention relates to a resilient foam pad that is integrated into the bottom exterior of a tool bag. More specifically, the invention relates to maximizing the inter-compatibility of a tool bag and a highly portable foam pad. The upper surface of the foam pad is adorned with a nylon loop fastener attracting carpet. Attached to the bottom side of the tool bag is a nylon hook fastener lining. The tool bag is designed to offer storage and detachment of the foam pad without having to open the tool bag compartment. Alternative embodiments of the foam pad would include a rubber sealed version for use in wet conditions.

2 Claims, 3 Drawing Sheets

TOOL BAG WITH INTEGRATED EXTERIOR FOAM PAD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of tool bags and foam pads.

B. Prior Art

The Spencer Patent Application (U.S. App. No. 2003/0019007) discloses a knee cushion with integrated support depressions.

The Kehoe Patent (U.S. Pat. No. 5,546,671) discloses a multi-purpose roofing tool kit that assists a roofer in the covering of a roof surface with shingles or tiles. This kit includes foam rests, and these foam rests remain part of a large assembly of tools that are inside a chest, which in essence fails to provide rapid deployment or storage for knee pads.

The Escobedo Patent (U.S. Pat. No. Des. 447, 850) illustrates an ornamental design for a kneeling pad.

The Ouellette et al. (U.S. Pat. No. 6,883,177) discloses an oil resistant portable knee pad designed to magnetically attach to a metal surface when not in use.

The McDowall Patent (U.S. Pat. No. 4,789,046) discloses a rigid lightweight knee board for cement finishers The Ward Patent (U.S. Pat. No. 3,544,054) discloses an upwardly arched pair of padded knee boards designed for cement finishers.

The Crain Patent (U.S. Pat. No. 4,043,424) discloses an improved kneeling apparatus for cement masons.

The Bidwell et al. Patent (U.S. Pat. No. Des. 376, 481) illustrates an ornamental design for a kneeling pad.

BRIEF SUMMARY OF THE INVENTION

The present invention relates to a resilient foam pad that is integrated into the bottom exterior of a tool bag. More specifically, the invention relates to maximizing the inter-compatibility of a tool bag and a highly portable foam pad. The upper surface of the foam pad is adorned with a nylon loop fastener attracting carpet. Attached to the bottom side of the tool bag is a nylon hook fastener lining. The tool bag is designed to offer storage and detachment of the foam pad without having to open the tool bag compartment. Alternative embodiments of the foam pad would include a rubber sealed version for use in wet conditions.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
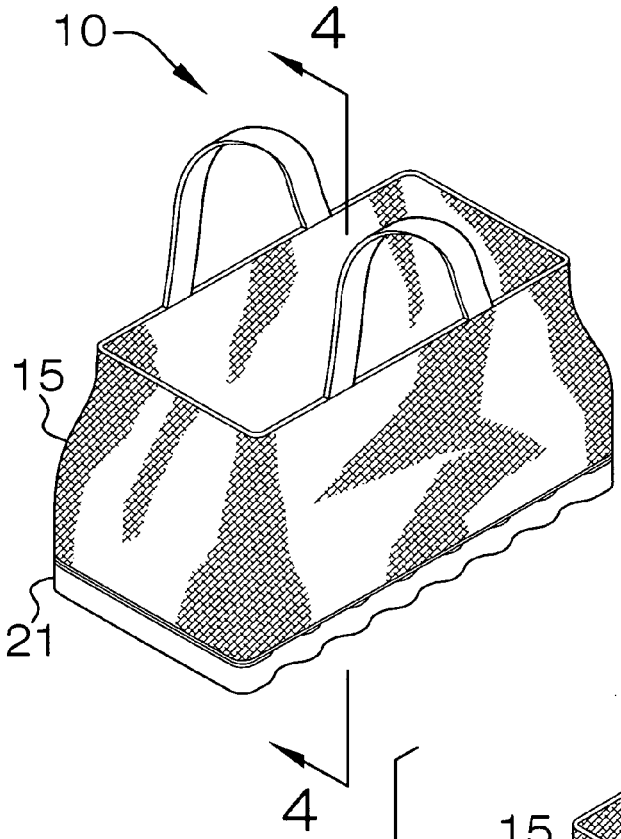
FIG. 1 illustrates an isometric view of the invention by itself.

Detailed reference will now be made to the preferred embodiment of the present invention, examples of which are illustrated in FIGS. 1-5. An invention 10 comprises a tool bag 15, a nylon hook fastener lining 30, a foam pad 21, and nylon loop fastener attracting speaker box carpet 20. The shape of the foam pad 21, nylon hook lining 30, and nylon loop fastener attracting carpet 20 are designed to reflect the exact shape of the bottom side of the tool bag 15.

Figure 2:
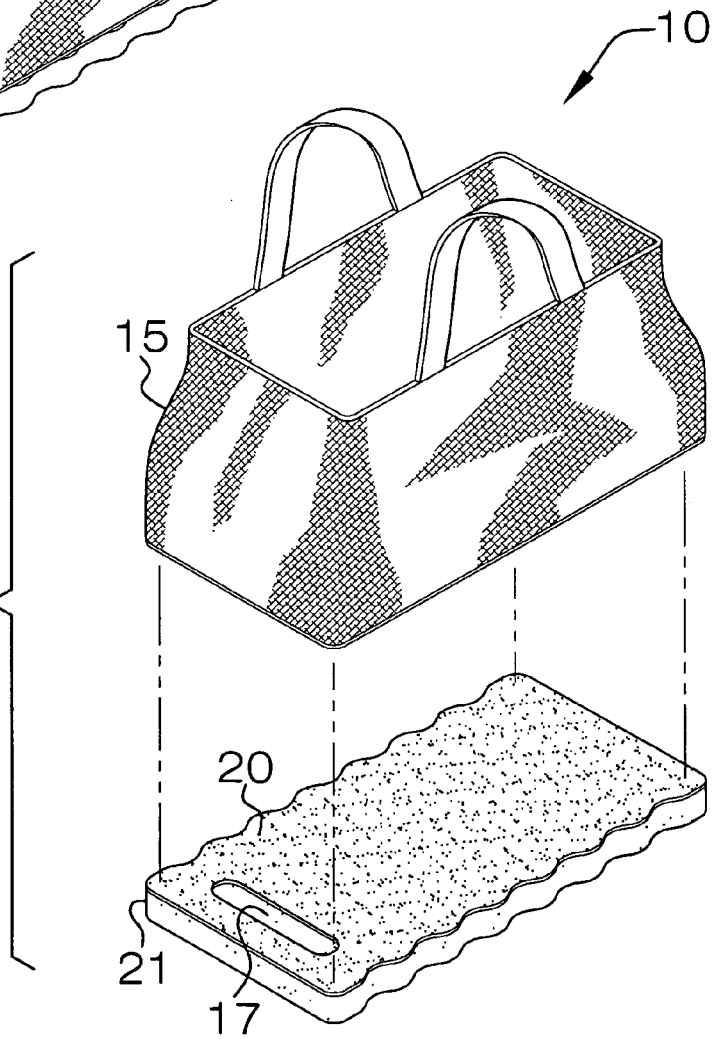
FIG. 2 illustrates an isometric view of the invention illustrating the alignment and detachment of the foam pad.
Figure 3:
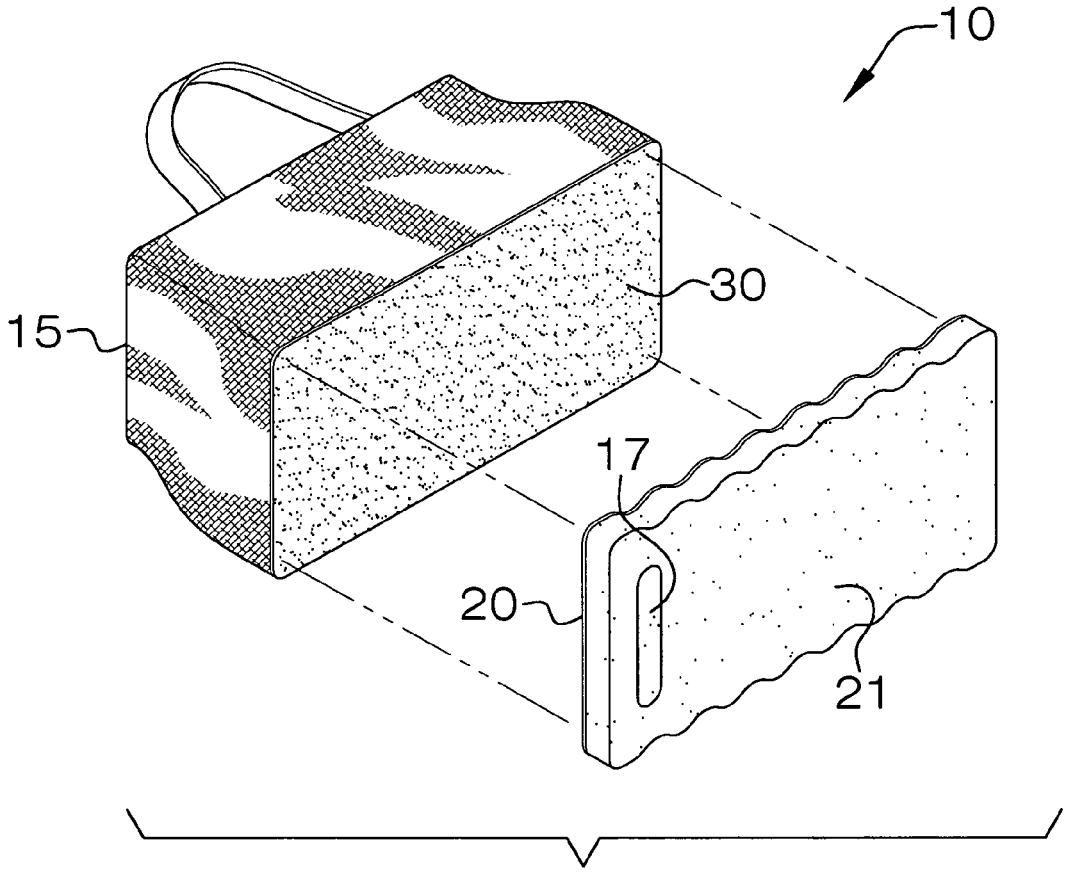
FIG. 3 illustrates an isometric view of the invention illustrating a view from a different angle.

A plurality of handle cut-out sections 17 allows a user to grip the foam pad during its removal, placement, and storage. Referring to FIG. 2 a foam pad 21 has the nylon loop fastener attracting carpet 20 attached to the top layer of the foam pad by a means comprising adhesives, rivets, staples, and/or sewing. Nylon loop fastener attracting carpet 20 has a respective number of handle cut-outs positioned in respective locations so that when assembling the foam pad 21 to the nylon loop fastener attracting carpet 20, the handle cut-out sections 17 are aligned to form a complete handle cut-out. The tool bag 15 also has the nylon hook lining 30 that is attached to the bottom of the tool bag. The attachment of the nylon hook lining 30 can be attached to the tool bag by the use of adhesives, rivets, staples, and/or sewing. The addition of the foam pad 21 provides additional protection for the bottom of the tool bag 15. FIG. 2 also shows the tool bag 15 and foam pad 21 detached from each other.

The foam pad 21 attaches to the tool bag 15 by aligning and pressing together the nylon loop fastener attracting carpet 20 and the nylon hook lining 30, respectively. Using the handle cut-out 17, the foam pad 21 can be removed from the invention 10 by pulling apart nylon loop fastener attracting carpet 20 from the opposing nylon hook lining 30. The end-user would place the nylon loop fastener attracting carpet 20 face up for cushioning of any part of the end-user's body. An alternative embodiment of the foam pad 21 would include a rubber sealed embodiment that would be usable under wet conditions.

Figure 4:
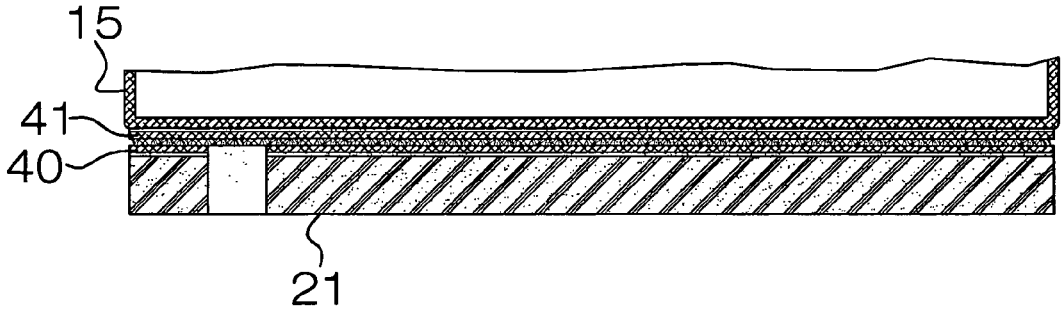
FIG. 4 illustrates a cross-sectional view along line 4-4.
Figure 5:
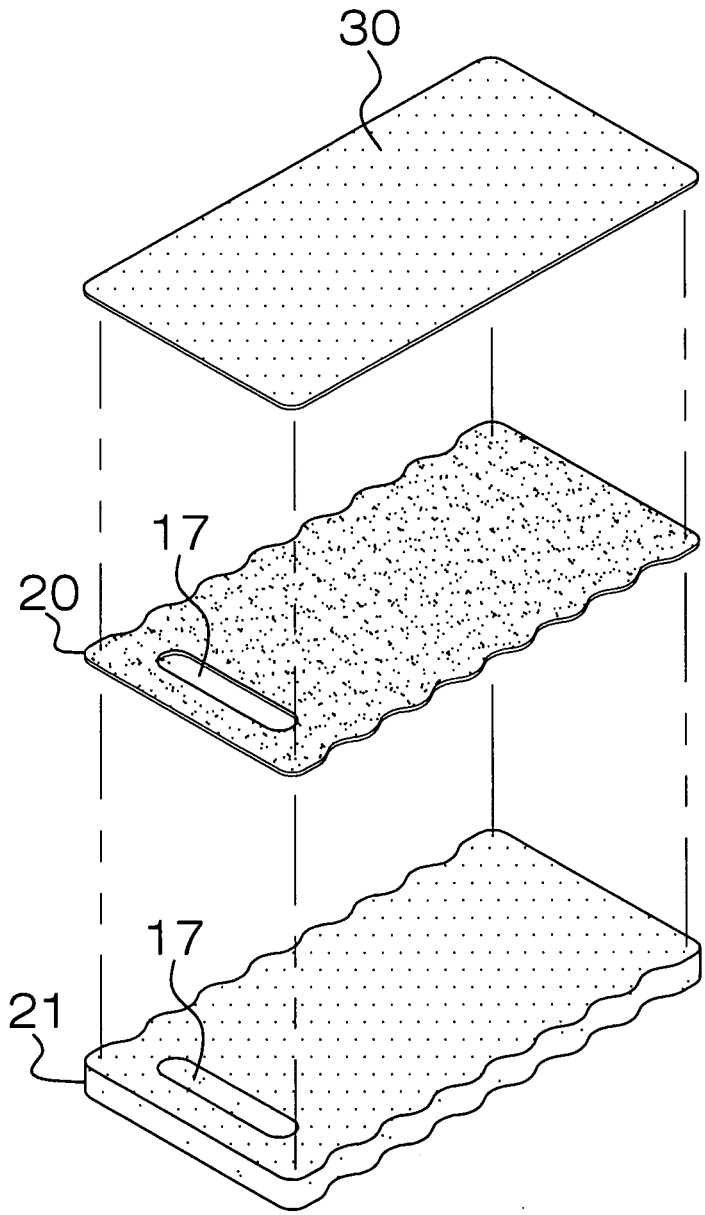
FIG. 5 illustrates an isometric view of the multiple layers comprising the foam pad and tool bag.

Detailed reference will now be made to an adhesive embodiment. Referring to FIG. 4 the foam pad 21 and the nylon loop fastener attracting carpet 20 are attached by an adhesive substrate 40. The bottom side of the tool bag 15 and the opposing nylon hook lining 30 are attached by an adhesive substrate 41.

I claim:

1. A tool bag with integrated exterior foam pad comprising:

(a) a tool bag;

(b) nylon hook lining attached to the bottom-side of the tool bag by a means comprising adhesive, riveting, stapling, and/or sewing;

(c) a foam pad with a handle cut-out;

(d) a nylon loop fastener attracting carpet with a a handle cut-out attaches to the non-resilient side of the foam pad by a means comprising adhesive, riveting, stapling, and/or sewing.

2. The tool bag with integrated exterior foam pad as described in claim 1 wherein the foam pad is removed by grabbing the handle cut-out and pulling the tool bag apart from the foam pad;

wherein the resilient side of the nylon loop fastener attracting carpet is placed face side up for cushioning the end user's body; or wherein the resilient side of the foam pad is placed face side up for cushioning the end user's body.

* * * * *